United States Patent [19]

Grimsley

[11] Patent Number: 4,890,728

[45] Date of Patent: Jan. 2, 1990

[54] TRAVEL KIT ASSEMBLY

[76] Inventor: John Grimsley, 201 NW. 41 St., Pompano Beach, Fla. 33064

[21] Appl. No.: 335,747

[22] Filed: Apr. 10, 1989

[51] Int. Cl.[4] ..... A45C 1/06

[52] U.S. Cl. ..... 206/0.81; 206/232; 206/472; 206/473; 150/147; 229/72

[58] Field of Search ..... 206/0.81, 232, 472, 206/473; 150/147, 132, 143, 139; 229/72

[56] References Cited

U.S. PATENT DOCUMENTS

| | | | |
|---|---|---|---|
| 364,623 | 6/1887 | Beidler | 206/472 X |
| 1,017,006 | 2/1912 | Lee | 206/232 |
| 1,037,264 | 9/1912 | Kimmel | 150/139 X |
| 1,088,059 | 2/1914 | Cardwell | 150/143 |
| 1,116,660 | 11/1914 | Willis | 206/0.81 X |
| 1,228,251 | 5/1917 | Smith | 150/132 |
| 1,269,247 | 6/1918 | Aslin | 150/139 X |
| 1,564,152 | 12/1925 | Thomson | 206/472 |
| 1,677,770 | 7/1928 | Harnsberger | 150/132 X |
| 1,679,500 | 8/1928 | Sanford | 206/0.81 X |
| 1,683,996 | 9/1928 | Snow | 229/72 X |
| 2,161,015 | 6/1939 | Buxton | 150/147 X |
| 2,550,437 | 4/1951 | Yates | 150/132 X |
| 2,732,874 | 1/1956 | Carstensen | 150/147 |
| 2,982,322 | 5/1961 | Seitz | 229/72 X |
| 3,058,506 | 10/1962 | Parisi | 229/72 X |
| 3,267,980 | 8/1966 | Bird | 150/139 X |
| 3,297,069 | 1/1967 | Aburto | 206/0.81 X |
| 3,360,027 | 12/1967 | Price | 229/72 X |
| 3,446,260 | 5/1969 | Osher | 150/147 |
| 3,847,195 | 11/1974 | Tyrseck | 229/72 X |
| 3,933,294 | 1/1976 | Meenan et al. | 229/72 X |
| 4,314,635 | 2/1982 | Fraser et al. | 206/232 |
| 4,429,787 | 2/1984 | Morse | 229/72 X |
| 4,492,390 | 1/1985 | Jacobs et al. | 229/72 X |
| 4,781,379 | 11/1988 | Parks | 150/147 X |

FOREIGN PATENT DOCUMENTS

| | | | |
|---|---|---|---|
| 708332 | 7/1941 | Fed. Rep. of Germany | 150/147 |
| 544887 | 7/1922 | France | 150/132 |
| 1459254 | 10/1966 | France | 150/147 |
| 1471423 | 1/1967 | France | 150/132 |
| 106398 | 5/1917 | United Kingdom | 150/132 |

*Primary Examiner*—William Price
*Attorney, Agent, or Firm*—Malloy & Malloy

[57] ABSTRACT

A travel kit in the form of a foldable multi-panel base having a multi-page insert means secured to one of two fold lines about which the panels are selectively positioned into overlapping relation with one another wherein interior surfaces of the panels and each oppositely disposed interior surface of the pages each include containment means which may be in the form of one or more specifically structured and configured pockets to hold a plurality of different objects including but not limited to documents, passports, paper and coin currency, etc. in a readily accessible location for both storage and removal thereof.

14 Claims, 2 Drawing Sheets

TRAVEL KIT ASSEMBLY

BACKGROUND OF THE INVENTION

1. Field of the Invention

This invention relates to a document containment structure in the form of a travel kit or folder specifically designed to hold any number of a plurality of documents which are used during extensive traveling particularly in foreign countries wherein such documents include tickets, maps, passports, currency and the like and being of a size to be carried on a traveler's person.

2. Description of the Prior Art

Wallets and like foldable assemblies have been existent in the prior art for many years. While typically wallets are designed to hold paper currency and the like, wallet structures have been expanded to include holding or containment structures for a plurality of other types of documents. However, such wallet type assemblies are normally inconvenient when it is desirable to contain therein a variety of different types of documents particularly of the type which are convenient or necessary when traveling extensively such as in foreign countries. A foreign traveler must, by necessity, have ready access to numerous important documents including tickets for traveling, passports, visas, other identification, maps and also particularly foreign currency both in paper and coin form.

Conventionally structured prior art folder type wallets of the type mentioned above are generally demonstrated in the following representative U.S. patents. Carstensen, 2,732,874 discloses a folding data case for the holding of a plurality of data cards readily accessible for viewing and containment.

Similarly, Price, U.S. Pat. No. 3,360,027; discloses a ticket and money holder primarily for use at sporting events such as horse or dog racing and structured to include small pocket book or pouch type structures having a plurality of pockets for such containment. Osher, U.S. Pat. No. 3,446,260; discloses a card holder for a wallet including transparent insert means in which spaces between flaps are provided for receiving the cards to be contained and viewed without the necessity of removing such cards from the insert.

Tyrseck, U.S. Pat. No. 3,847,195; discloses a check wallet and blank made from a single card board blank and having three pages connected along a common hinge line wherein each page includes a pocket to hold various slips of paper. The pockets are of common dimension and configuration and are not adapted to hold a variety of documents as is amply evident in a review of this patent.

Jacobs, U.S. Pat. No. 4,492,390; discloses a combined airline ticket holder and advertising booklet including a front and back cover joined along a common fold line and including a pocket structure located between the two covers as well as being structurally adapted to hold a booklet having a plurality of pages on which advertising is displayed.

The patents to Cardwell, U.S. Pat. No. 1,088,059 and Asline, U.S. Pat. No. 1,269,247 both disclose a wallet like structure primarily designed for the carrying of currency and including a plurality of pockets formed therein to accomplish such containment and further wherein various portions of the wallet structure folds upon itself. A plurality of pockets are not formed of different configuration, size and location for the containment and ready accessibility of numerous documents related specifically to a foreign traveler. Similarly, Harnsberger, U.S. Pat. No. 1,677,770; discloses a pocket wallet for paper, memos, cards, letters, etc. which is made out of a single blank and conveniently folded upon itself to form a number of pockets of varying sizes.

While the above noted patents are generally considered to be operative for their intended function and purpose, their is still a recognized need in this field for a travel kit or assembly having a plurality of panels defining a base and capable of having permanently and pivotally mounted therein an insert itself comprising a plurality of pivotal pages wherein a variety of different pockets each having varying configurations and sizes, to at least a certain extent, are provided to hold varying types of objects including but not limited to documents, currency, passports, and the like.

SUMMARY OF THE INVENTION

The present invention relates to a travel kit or like assembly specifically designed to hold documents, currency and like objects which are necessary for and provided in a readily accessible location to a person during travel, especially during foreign travel. The objects contained within the subject assembly may include but are not limited to tickets, passports, visas, currency, maps, etc.

The subject travel kit assembly includes a base which may be considered an outer folder including three panels. The three panels are more specifically defined by two outer panels pivotally connected to a middle panel along spaced apart substantially parallel fold lines or portions such that the two outer panels may overlap one another and be positioned in overlapping relation to the middle panel. A totally closed position of the folder comprises the outer surface of the middle panel defining an exposed exterior surface on one side of the closed assembly wherein an outer surface of one of the outer panels defines the opposite outer surface of the closed folder assembly. The outer panel positioned on the outside of the totally closed kit assembly may have a somewhat greater transverse dimension so as to accommodate overlapping and substantially covering relation to the other panels and structures of the subject folder assembly. The length of the panels are substantially the same and are generally in the range of approximately nine inches in length and five to six and a half inches in width.

Another structural feature of the present invention is the provision of a plurality of pages which may be permanently secured on the "interior" of the base or folder portion of the subject assembly and pivotally mounted along preferably a first of the aforementioned fold lines or portions oppositely disposed relative to the outer most panel of the base when the folder assembly is in its completely closed position. Each of the interior surfaces of each of the panels as well as the opposite interior surfaces of each of the pages of the insert portion are structured to include containment means formed thereon. The containment means may be in the form of a plurality of specifically disposed, dimensioned and configured pockets or compartments which while structured to have sufficient versatility to hold more than one type of document, may very well be configured and dimensioned to contain and make readily accessible a specific type of document such as a passport, ticket, etc. Also, the location of the various pockets and their design to hold a specific document or object is such as to render the accessibility of such objects more convenient based on frequency of use. For example, a pocket specifically designed to contain a ticket for immediate use would possibly be located in a more convenient location than would tickets for future use. Also, a pocket designed to hold a passport, of the size generally considered to correspond to the size of a U.S. passport would be located in a readily accessible and convenient location due to the frequency of use of ones passport for purposes of entering and leaving countries and also for purposes of identification.

The invention accordingly comprises the features of construction, a combination of elements, an arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
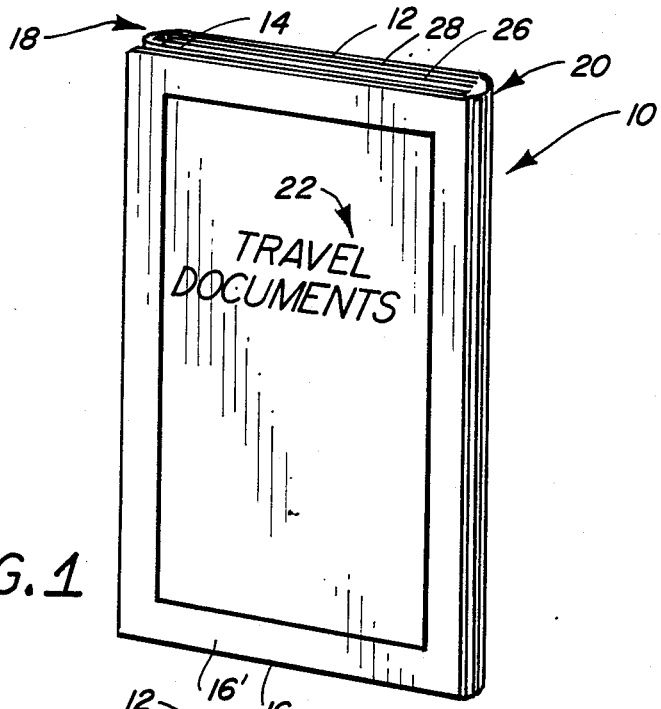
FIG. 1 is a perspective view of the travel kit assembly of the present invention in a completely closed position.
Figure 7:
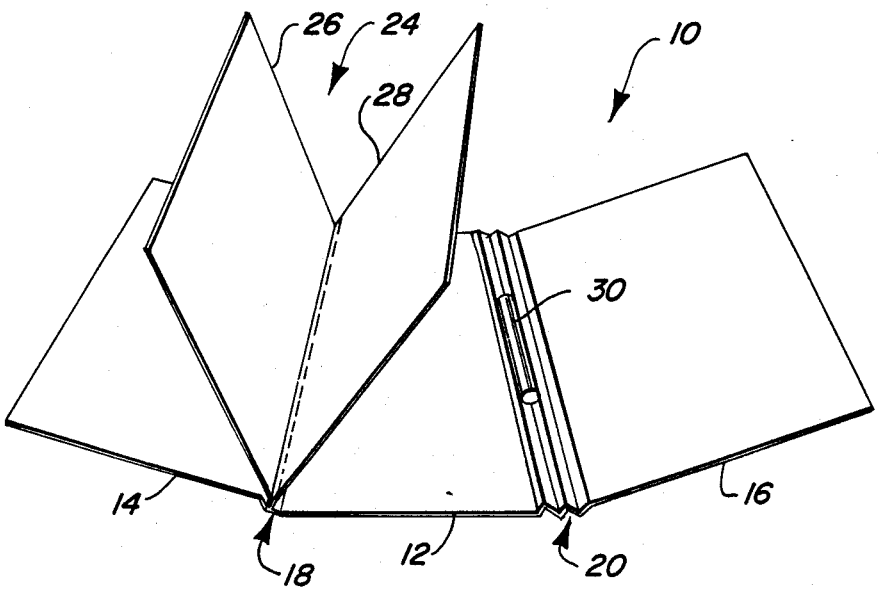
FIG. 7 is a perspective view of the various panels and pages of the insert structure shown relative to one another.

As shown in FIGS. 1 through 7, the present invention relates to a travel kit assembly in a folder type format generally indicated as 10. Initially with regard to FIGS. 1 and 7, the assembly comprises a base defined by three elongated interconnected panels 12, 14 and 16. As best shown in FIG. 7, the assembly 10 in its completely open position clearly demonstrates that the middle of the base panel 12 is interconnected to a first outer panel 14 along a first fold portion or line 18 and to the second outer base panel 16 along a second fold portion or line 20. The first and second outer panels 14 and 16 are of course allowed to pivot along the respective fold lines relative to and in overlapping relation with the middle base panel 12 to assume either a partially open position as will be described in greater detail with regard to FIGS. 2, 3 and 4 and also into a completely closed position as demonstrated in FIG. 1. It can also be shown in FIG. 7 that each of the base panels 12, 14 and 16 are of substantially a common length in the range of approximately nine inches. Further, the first outside panel 14 and the middle panel 12 have a substantially common transverse dimension generally in the range of approximately five inches. However, the second outside panel 16 has a somewhat greater transverse dimension generally in the range of approximately six and a half inches since this second outside panel 16 assumes the outermost position a demonstrated in FIG. 1 when the assembly 10 is in its completely closed position. In such completely closed position, the outer surface 16′ of the second outer base panel 16 represents one of the exposed surfaces of the assembly and may be appropriately labeled by any type of indicia such as "travel documents" generally represented as 22. The outer surface of the middle panel 12 (not shown for purposes of clarity) represents the other exposed outer surface of the assembly 10 when it is in its fully closed position as shown in FIG. 1. Since the second outer base panel 16 overlaps other panels of the assembly 10, the structure of the second fold portion or line 20 may be somewhat accordion-like structure and may be larger in its transverse dimension so as to accommodate additional expansion than that required from the first fold line 18.

Figure 3:
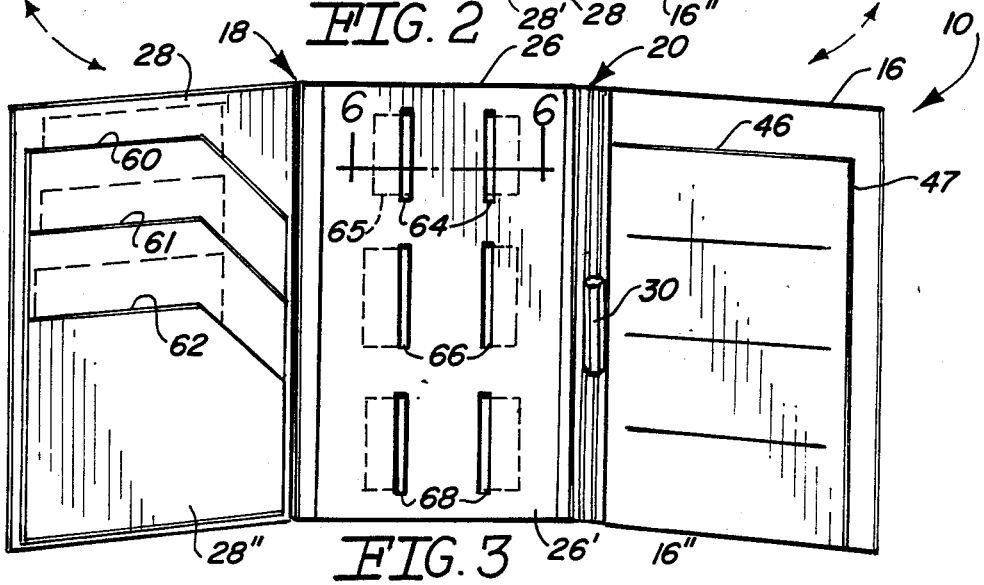
FIG. 3 is a perspective view showing an exposed open position confronting surfaces of different pages of the insert structure as well as the interior surface of one of the outside panels.
Figure 4:
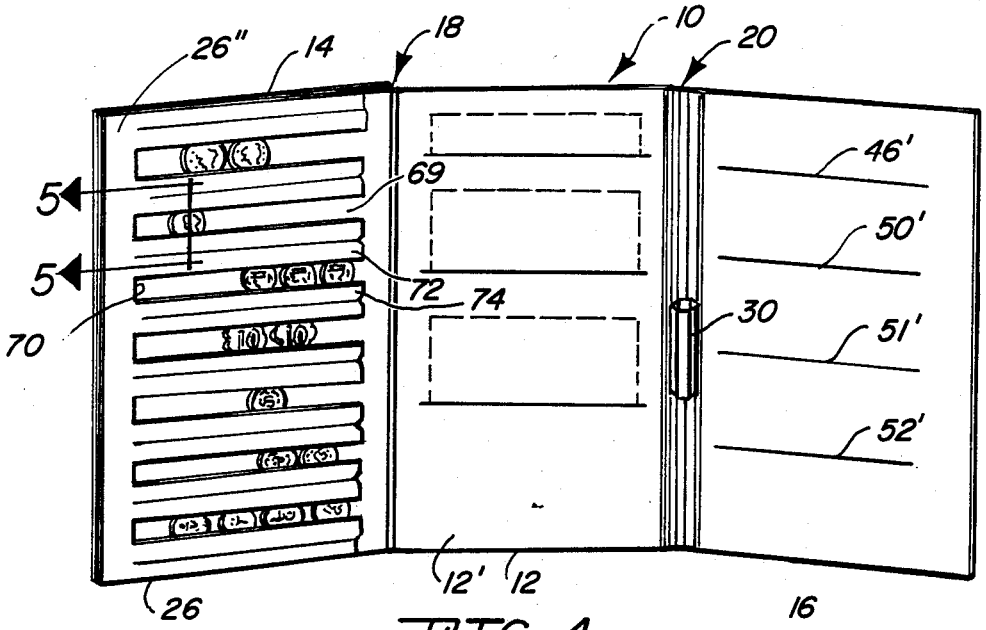
FIG. 4 is a perspective view of an inner surface of a last of the pages of the insert structure as well as the two inner surfaces of a middle and outside panel of the folder structure.
Figure 5:
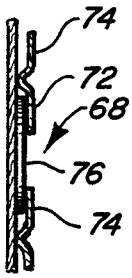
FIG. 5 is a sectional view along line 5—5 of FIG. 4.
Figure 6:
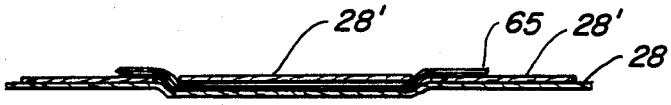
FIG. 6 is a sectional view n partial cut-away along line 6—6 of FIG. 3.

As shown in FIG. 7 as well as additional FIGS. 1, 3, and 4, the assembly 10 further comprises an insert structure generally indicated as 24 defined by a plurality, preferably two pages 26 and 28 each of which are secured on the interior of the base between panes 12 and 14 and along the length of the first fold portion 18. It should be readily apparent that each of the pages 26 and 28 may also be pivotal relative to the panels 12 and 14. For purposes of selective exposure of both opposite surfaces of each page 26 and 28. Also, the insert assembly 24 may be permanently attached so as to be a part thereof and the term "pages" are not meant to be representative of a paper-like page found in a book but more specifically, the pages 26 and 28 are formed from a more substantial material such that pockets or compartments may be formed in both of the opposite surfaces thereof as will be explained in greater detail hereinafter.

Figure 2:
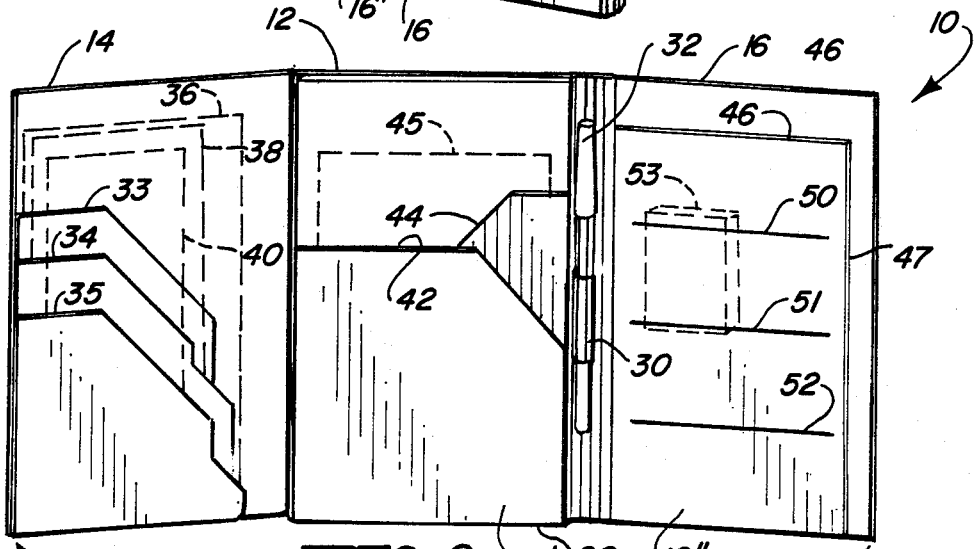
FIG. 2 is a perspective view of the subject assembly exposing inner surfaces of both outside panels and one surface of a first page of an insert structure associated with the assembly.

Another structural feature clearly shown in FIGS. 2, 3, 4 and 7 is the provision of a writing instrument holder in the form of an elongated hollow open ended sleeve member 30 attached on the interior of the assembly 10 between the middle and outer panels 12 and 16 generally along the length of the second fold portion 20. Any type of applicable writing instrument such as 32 may be placed therein and be readily accessible for use as shown in FIG. 2.

With regard to FIG. 2, an inner surface of the first outer panel 14 comprises containment means in the form of a plurality of spaced-apart pockets each extending along a portion of the length of the panel 14 and each having an open end as at 33, 34, 35, respectively. Each open end 33 through 35 may have a substantially transverse portion and a downwardly angled portion as clearly indicated for the easy insertion and removal of a plurality of documents such as but not limited to travel tickets in use as at 36, boarding passes 38 and/or custom or immigration forms 40. It can be seen that each of the pockets based on their staggered spaced apart openings 33, 34 and 35 have varying interior lengths to accommodate documents of various lengths. Similarly in FIG. 2, one of two opposite surfaces of a first page 28 of the insert structure 24 is shown having a single pocket extending along the length of the page 28 with a double flange open end 42, 44 overlapping one another and rising to different positions along the length of the surface 28′ as shown. Contained therein may be a document such as a passport or other identification papers or papers containing medical records, etc. indicated as 45. Also in FIG. 2, a central elongated pocket having an open end and open side portions 46 and 47 providing access to the elongated pocket may be provided for holding any number of various size receipts or the like. One or more "slash" openings are transversely oriented and provide access to one or more additional pockets as at 50, 51 and 52 for the mounting and/or at least partial insertion of note pads as at 53.

FIG. 3 demonstrates an open position of the assembly 10 wherein the opposite inner surface 28" of on of the pages 28 of the insert assembly 24 is exposed as is a correspondingly positioned surface 26' of the other insert page 26. As can be seen, the surface 28" of the one insert page 28 comprises a plurality of pockets 60, 61 and 62 each extending along the length of the page 28 and having different depths based on the positioning of the spaced-apart open ends 60, 61 and 62. Rather than a complete transverse orientation of the respective ends, they may also be at least angled in part as shown in FIG. 3.

Also as demonstrated in FIG. 3, the correspondingly positioned surface 26' of the other insert page 26 may be specifically designed to have a plurality of compartments formed therein as at 64, 66 and 68 wherein each compartment is designed to carry currency as at 65 of one or various countries for either current or future use depending upon the location of the traveler.

With regard to FIG. 4, the opposite surface 26' of the insert page 26 is designed to include a plurality of compartments each in the form of a plurality of sleeves generally indicated as 68, each having an elongated configuration with an open end as at 69 and a closed end a at 70. Each sleeve is defined by two spaced-apart brace portions 72 and 74 disposed in substantially spaced relation to one another and spaced apart a predetermined distance so as to engage but allow sliding movement relative thereto of an appropriate sized coin 76. The sleeves may have varying transverse dimensions, of course, to accommodate coins of various sizes wherein such coins can be used for telephone or any other obvious reasons and further wherein the coins of various countries may be separated into different sleeves. An elongated slot extends along the length of the exposed face of each sleeve such that the interior of the sleeve may be viewed along with the existence or absence of any coin a at 76 therein.

Also as shown in FIG. 4, the inner surface of the middle panel 12 as at 12' may also contain a plurality of spaced-apart individual pockets of varying depths since the pockets extend along the length of the middle panel 12. Such pockets are readily adaptable for addresses, telephone numbers, cards, credit cards, etc.

Now that the invention has been described, what is claimed is:

1. A travel kit assembly designed to hold a plurality of documents, currency and like objects in separated, readily accessible location, said assembly comprising:

a. a base comprising three elongated panels each pivotally connected to a next adjacent panel along either a first or a second fold portion, b. an insert assembly mounted on said base along a length of one of said first or second fold portion and comprising a plurality of pages each pivotal about said one fold portion between correspondingly adjacent ones of said panels, c. each of said pages comprising opposite surfaces including containment means formed thereon for removable holding of at least one object on the correspondingly positioned opposite surfaces, d. said base and said insert assembly selectively foldable into and out of a closed or an open position, e. said open position defined by at least one of said panels disposed in spaced non-overlapping position thereof relative to a next adjacent panel, f. said closed position defined by successive overlapping disposition of said insert assembly and each outside one of said three panels relative to a middle one of said three panels, g. said containment means also formed on inner surfaces of each of said three panels, whereby a plurality of different objects may be removably contained on exposed surfaces of said panels and said plurality of pages in readily accessible position.

2. An assembly as in claim 1 wherein said plurality of pages of said insert assembly are at least two in number, at least one surface of one of said pages being and having a plurality of pockets formed thereon in a stacked orientation and each structured to contain one type of a plurality of documents therein.

3. An assembly as in claim 2 wherein each of said pockets comprise transverse openings disposed in spaced relation to one another along the length of said one page.

4. An assembly as in claim 3 wherein said one page comprises an opposite surface having at least one pocket therein of sufficient depth to contain a U.S. passport therein and a substantially transverse opening and said pocket being elongated and extending along the length of said page.

5. An assembly as in claim 2 wherein a second one of said two pages comprises at least one of said opposite surfaces comprising a plurality of compartments structured to hold currency therein.

6. An assembly as in claim 5 wherein said second one of said pages comprises another of said opposite surfaces including a plurality of compartments each structured to removably hold a plurality of coins therein.

7. An assembly as in claim 6 wherein said plurality of compartments each comprise an elongated sleeve having an open end and an oppositely disposed closed end, each sleeve including an elongated slot extending along the length thereof and formed in an outer face and further disposed to allow viewing of the interior of the sleeve and any coins contained therein.

8. An assembly as in claim 7 wherein each sleeve is defined by spaced apart elongated brace elements disposed in parallel relation and spaced apart a sufficient distance to engage and allow passage there along of coins.

9. An assembly as in claim 5 wherein a middle panel of said plurality of panels comprises a plurality of pockets formed therein and extending along the length thereof and each pocket comprising an open end oriented transversely to the length of said middle panel.

10. An assembly as in claim 9 wherein at least two of said pockets have varying depths for containing any one of a plurality of documents.

11. An assembly as in claim 9 wherein a first outside one of said plurality of panels comprises a plurality of pockets formed therein and extending along the length thereof and each pocket comprising an open end oriented transversely to the length of the first outside panel.

12. An assembly as in claim 11 wherein at least two of said pockets comprise varying depths for containing any one of a plurality of documents therein.

13. An assembly as in claim 11 wherein a second outside one of said plurality of panels comprises a plurality of pockets formed therein and having interior portions extending along the length thereof and each pocket comprising an open end oriented transversely to the length of said middle panel in spaced relation to the remainder of the open ends of the remainder of said pockets.

14. An assembly as in claim 13 wherein at least two of said pockets have varying depths along the interior thereof for containing any one of a plurality of documents therein.

* * * * *